US008783431B2

(12) United States Patent
Wu

(10) Patent No.: US 8,783,431 B2
(45) Date of Patent: Jul. 22, 2014

(54) FAST DETACHABLE SIDE WHEEL DEVICE

(76) Inventor: Chen-Chuan Wu, Hsin Chuang (TW)

( * ) Notice: Subject to any disclaimer, the term of this patent is extended or adjusted under 35 U.S.C. 154(b) by 508 days.

(21) Appl. No.: 13/105,339

(22) Filed: May 11, 2011

(65) Prior Publication Data

US 2012/0285780 A1 Nov. 15, 2012

(51) Int. Cl.
*A45C 5/14* (2006.01)

(52) U.S. Cl.
USPC ..... 190/18 A; 301/111.05; 16/30

(58) Field of Classification Search
USPC ..... 190/18 A; 301/111.05; 16/30
See application file for complete search history.

(56) References Cited

U.S. PATENT DOCUMENTS 2,002,836 A * 5/1935 Rossi ..... 280/645
5,396,974 A * 3/1995 Pedlar ..... 190/18 A
5,407,039 A * 4/1995 Alper et al. ..... 190/18 A
6,167,994 B1 * 1/2001 Kuo et al. ..... 190/18 A
6,193,324 B1 * 2/2001 Chang ..... 301/111.05
6,212,733 B1 * 4/2001 Yeh ..... 16/35 R
6,253,891 B1 * 7/2001 Miller ..... 190/18 A
6,382,736 B1 * 5/2002 Chang ..... 301/111.05
8,251,391 B2 * 8/2012 Kohler et al. ..... 280/250.1

* cited by examiner

*Primary Examiner* — Tri Mai
(74) *Attorney, Agent, or Firm* — Muncy, Geissler, Olds & Lowe, P.C.

(57) ABSTRACT

A fast detachable side wheel device, comprising: a first wheel cover, a second wheel cover, a wheel body, and a movable component. Firstly, wheel body is fixed in first receiving groove of second wheel cover as a replaceable component. Through positioning of a dovetail groove of first wheel cover and a dovetail tenon of second wheel cover, thus vibration, collision, or detachment of wheel body due to outside force can be avoided. Then, the movable component is used to control the positioning or detaching states between first wheel cover and second wheel cover, thus achieving fast and labor saving assembly and detachment of side wheels.

5 Claims, 12 Drawing Sheets

FAST DETACHABLE SIDE WHEEL DEVICE

BACKGROUND OF THE INVENTION

1. Field of the Invention

The present invention relates to a fast detachable side wheel device, and in particular to a fast detachable side wheel device having it side wheels easily detachable without requiring any detaching tools.

2. The Prior Arts

For an ordinary luggage trunk structure presently on the market, refer to FIG. 1. As shown in FIG. 1, the luggage trunk structure includes a luggage trunk body 10, two drag wheels 12, two bottom footings 14, a plurality of side wheels 16, and an extensible-and-retractable pulling rod mechanism 18. Wherein, luggage trunk body 10 is used to accommodate various objects and items, the two drag wheels 12 and two bottom footings 14 are provided at the bottom of the luggage trunk body 10, such that the bottom footing 14 is used to make the luggage trunk body 10 stand firmly in a stable state. The back side of the luggage trunk body 10 is provided with a handle, and an extensible-and-retractable pulling rod mechanism 18 formed by two extensible-and-retractable pulling rods, so that user is able to pull out the two extensible-and-retractable pulling rods by the handle, hereby facilitating user to drag luggage trunk body 10 along while traveling through the rolling of the two drag wheels 12. Moreover, the side wheels 16 are fixed onto the sides of luggage trunk body 10 by means of screwing, riveting, or fastening, so that when the user is not moving, the luggage trunk can be placed and rests on the ground; and when the user is moving, he pushes the luggage trunk body 10 to move along through the rolling of side wheels 16 on the ground.

For this kind of luggage trunk structure mentioned above, though it can solve the problem of the conventional luggage trunk that, the side footings provided on the side are liable to be worn out due to its high friction with the ground, thus requiring user exerting much more effort to push and move the luggage trunk along. However, since the side wheels 16 are fixed to the sides of the luggage trunk body 10 through screwing or riveting, so installation and detaching tools are required when installing new side wheels 16 or replacing the worn out side wheels 16. Therefore, it has the shortcomings of requiring more time and efforts in operation and thus inconvenient in application.

Therefore, presently, the design and performance of the side wheel device of a luggage trunk is not quite satisfactory, and it has much room for improvement.

SUMMARY OF THE INVENTION

In view of the problems and shortcomings of the prior art, the present invention provides a fast detachable side wheel device, so as to overcome the problems of the prior art.

A major objective of the present invention is to provide a fast detachable side wheel device, that is simple in operation and effort saving in application, and it can be installed on moving objects such as furniture, luggage trunk, or large-sized packing bag; thus it can not only reduce friction between the moving object and the ground, increasing service life of the moving object, but it can also facilitate installation and replacement of the side wheel device.

Another objective of the present invention is to provide a fast detachable side wheel device, that is suitable for various applications, thus having a good competitive edge on the market.

In order to achieve the above-mentioned objective, the present invention provides a fast detachable side wheel device, comprising: as first wheel cover, provided with an installation part and a first receiving groove; a second wheel cover, disposed in the first receiving groove, and is provided with a positioning part and a second receiving groove; a wheel body, disposed in the second receiving groove; and a movable component, disposed in the installation part, and that includes a positioning element, such that the movable component controls the positioning element to position and fix it to the corresponding positioning part, or to detach the positioning element and the positioning part from the positioning state.

Further scope of the applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the present invention will become apparent to those skilled in the art from this detailed description.

BRIEF DESCRIPTION OF THE DRAWINGS

The related drawings in connection with the detailed description of the present invention to be made later are described briefly as follows, in which.

DETAILED DESCRIPTION OF THE PREFERRED EMBODIMENT

The purpose, construction, features, functions and advantages of the present invention can be appreciated and understood more thoroughly through the following detailed descriptions with reference to the attached drawings.

In some of our crowded living environment, in order to move objects in such a limited space, or have the facility to move objects, manufacturers of various movable objects, such as furniture, luggage trunks, or large-sized packing bags has put auxiliary wheels or side wheels on the movable objects, so as to facilitate changing its placement positions, its movements and detachments. However, presently, for the assembly and detachment of auxiliary wheels or side wheels, the process is tedious and complicated, and auxiliary tools are required to complete the work, thus causing quite inconvenience for the user. The objective of the present invention is to solve and improve the drawbacks and shortcomings of the conventional auxiliary wheel or side wheel in its assembly and detachment. The fast detachable side wheel device of the present invention mainly comprises: a first wheel cover, a second wheel cover, a wheel body, and a movable component. Wherein, the movable component is matched with different implementations depending on its positioning ways, it can be implemented in a forward positioning way or a side positioning way, and the details of which are described as follows.

Figure 1:
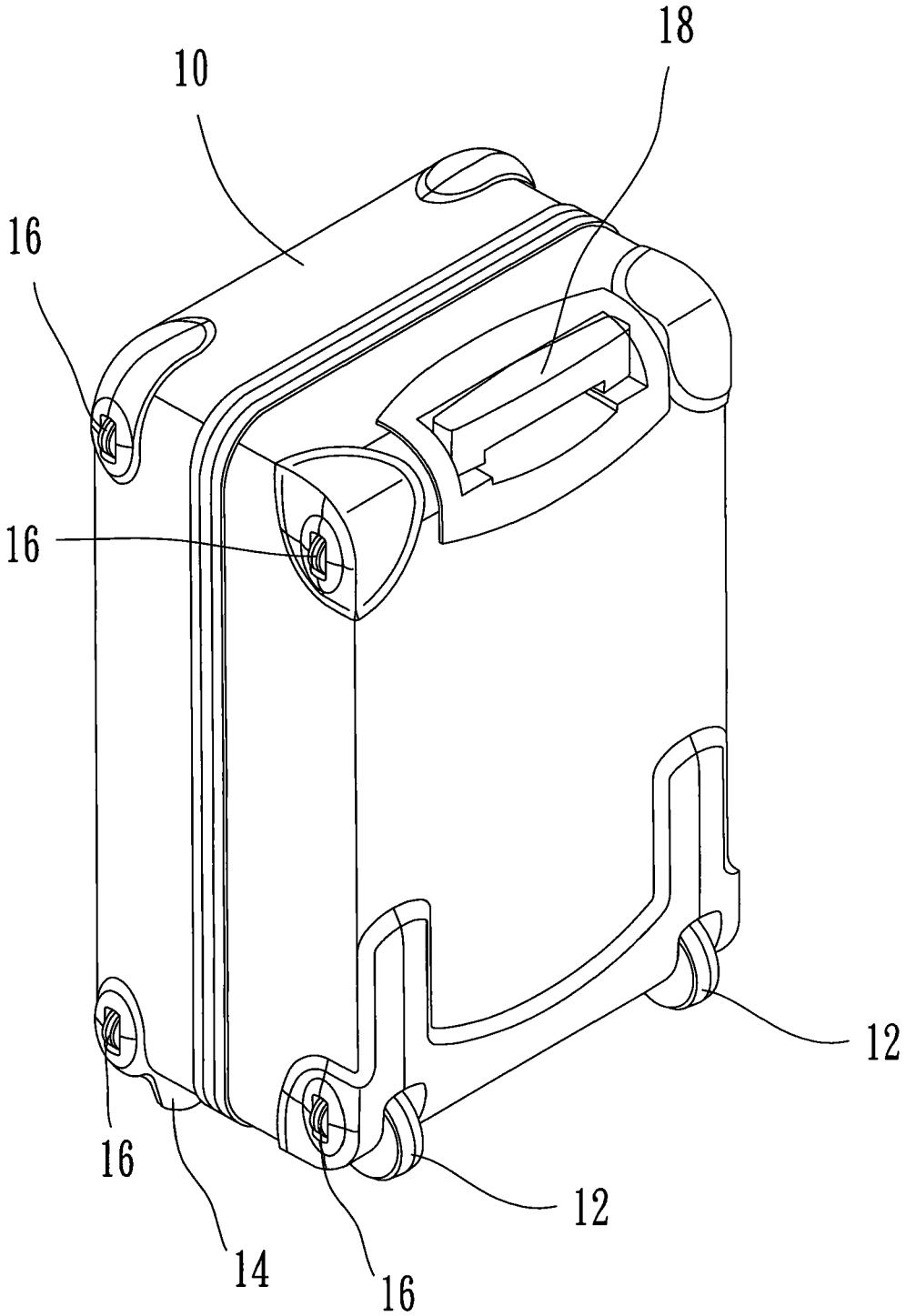
Fig. 1(prior art)
FIG. 1 is a schematic diagram of a luggage trunk structure according to the prior art.
Figure 2:
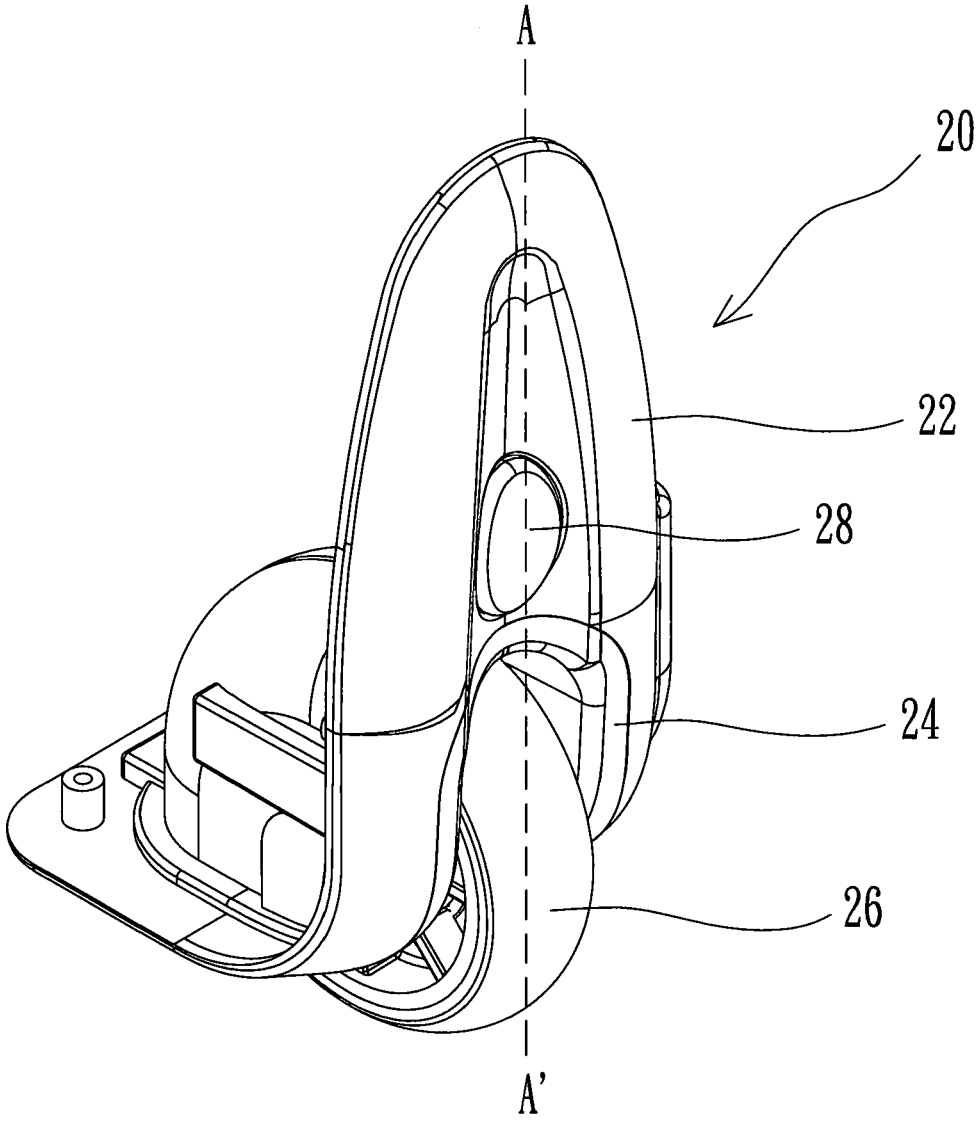
FIG. 2 is a perspective view of the fast detachable side wheel device according to the first embodiment of the present invention.
Figure 3:
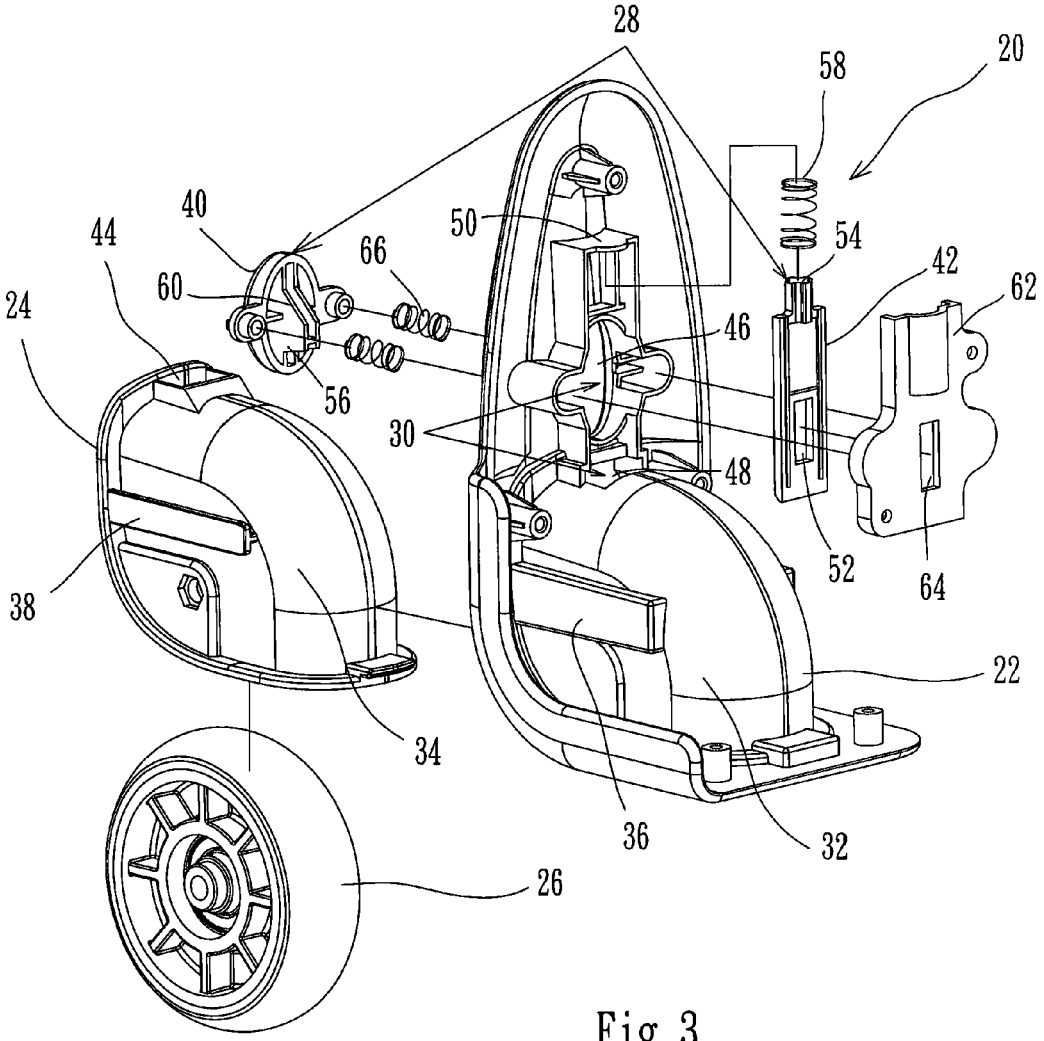
FIG. 3 is an exploded view of the fast detachable side wheel device according to the first embodiment of the present invention.

Firstly, the forward positioning way is described. Refer to FIGS. 2 and 3 simultaneously for a perspective view and an exploded view respectively of the fast detachable side wheel device according to the first embodiment of the present invention. As shown in FIGS. 2 and 3, the fast detachable side wheel device 20 comprises: a first wheel cover 22, a second wheel cover 24, a wheel body 26, and a movable component 28. The first wheel cover 22 is provided with an installation part 30 and a first receiving groove 32, and the second wheel cover 24 is provided with a second receiving groove 34 and a positioning part.

The first wheel cover 22 is screwed, riveted, or fastened onto an object in its initial installation, and the assembly and detachment of the first wheel cover 22 and the second wheel cover 24 will be described later. Firstly, the wheel body 26 is screwed, riveted, or fastened into the second receiving groove 34 of the second wheel cover 24, such that the second wheel cover 24 of the wheel body 26 can be used as a replaceable component. The inner side of the first receiving groove 32 of the first wheel cover 22 is provided with at least a dovetail groove 36, and preferably, two symmetric dovetail grooves 36 are designed on the inner left and right sides of the first receiving groove 32, and at least a dovetail tenon 38 is disposed on the outer side of the second receiving groove 34 of the second wheel cover 24. In order to matched the two dovetail grooves 36, two symmetric dovetail tenons 38 are designed on the outer left and right sides of the second receiving groove 34. Therefore, it has only to move the dovetail tenons 38 in the corresponding dovetail grooves 36, then the second wheel cover 24 can be fixed into the first receiving groove 32 of the first wheel cover 22. In this way, the first wheel cover 22 and the second wheel cover 24 can be fixed into position, to avoid vibration, collision, and detachment due to outside force. Finally, a movable component 28 is provided on the installation part 30 of the first wheel cover 22, and it includes a positioning element, such that the movable component 28 controls the positioning element to position and fix it to the corresponding positioning part of the second wheel cover 24, or detach the positioning element and positioning part from their positioning states.

In the above description, the movable component 28 is designed to be at the upper position of the first wheel cover 22. The movable component 28 includes a press piece 40 and a connection rod 42, that is used as a positioning element, and the positioning part of the second wheel cover 24 is a dent groove 44. The positioning part 30 of the first wheel cover 22 includes a first installation groove 46, a second installation groove 48, and a first retaining part 50. Wherein, the second installation groove 48 is in connection with the first receiving groove 32, and is perpendicular to the first installation groove 46; the first retaining part 50 is located above the first installation groove 46, the press piece 40 is positioned over the first installation groove 46, thus it can move in the first installation groove 46; and the connection rod 42 is provided in the second installation groove 48, such that it can move in the second installation groove 48. The connection rod 42 is provided with a first hole 52, and the upper end of the connection rod 42 is provided with an extension part 54, for at least a first restoring spring 58 to sleeve on, such that the first restoring spring 58 acts against the inner side of the first retaining part 50. The first hole 52 is located to a corresponding guiding block 56 of the press piece 40, the guiding block 56 is provided with a first slant side 60 located above the inner side of the first hole 52. The fast detachable side wheel device 20 further includes a first cover body 62, and is provided with a second hole 64 corresponding to the first hole 52. The first cover body 62 covers the movable component 28 and is fixed onto the first installation groove 46, so that at least a second restoring spring 66 is connected between the first cover body 62 and the press piece 40.

Figure 4A:
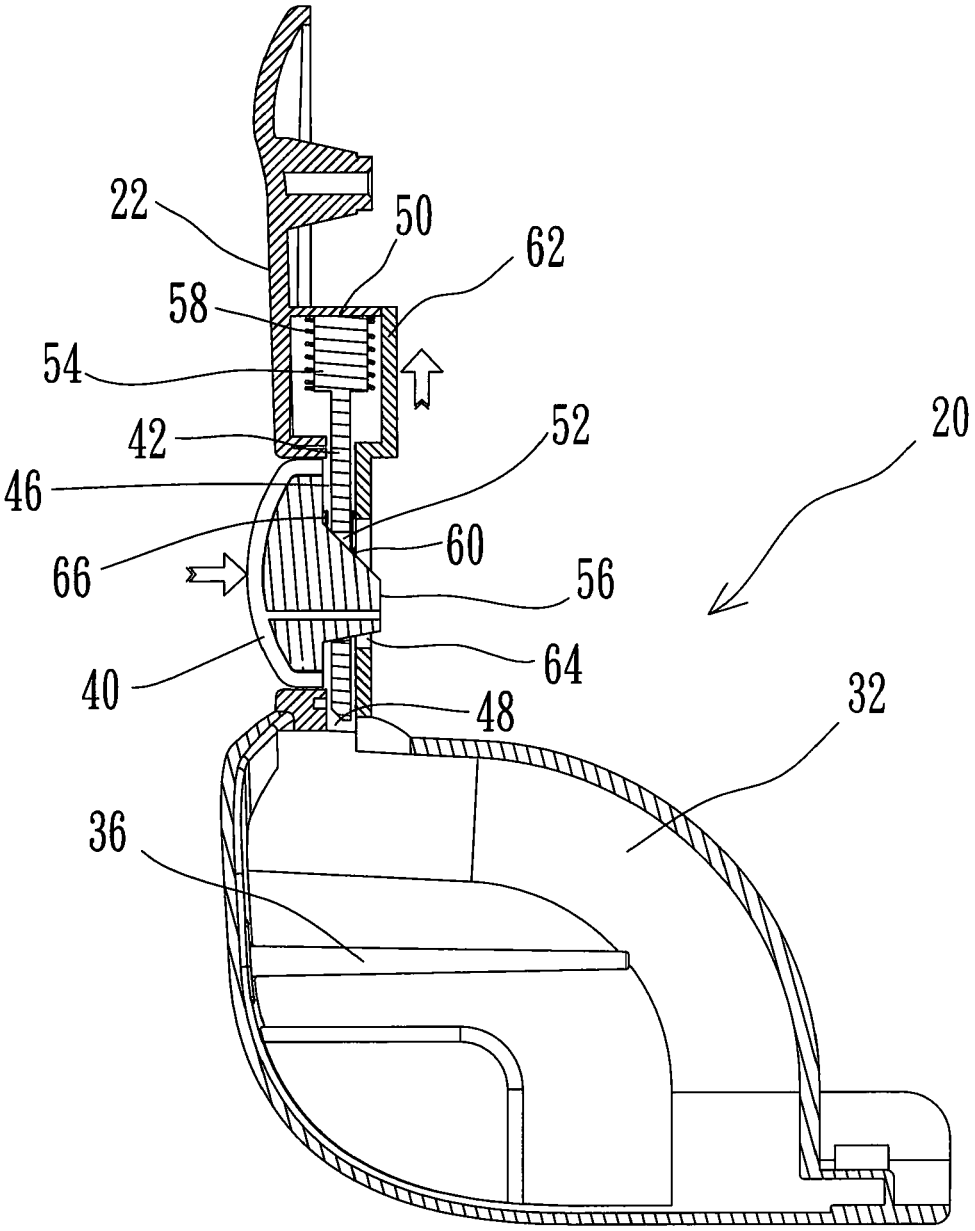
FIG. 4A is a cross section view along A-A' line of FIG. 2 before the assembly of wheel body.
Figure 4B:
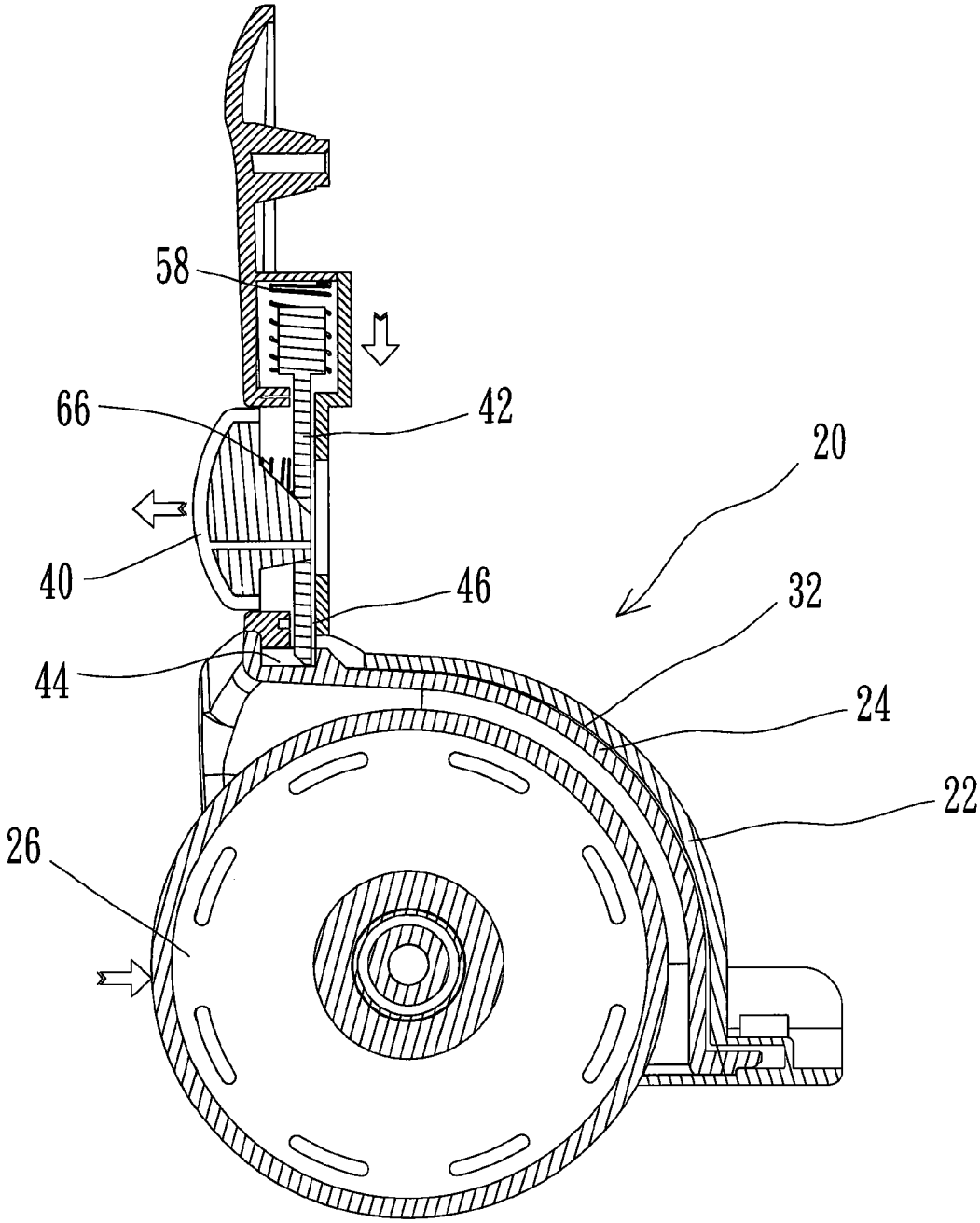
FIG. 4B is a cross section view along A-A' line of FIG. 2 after the assembly of wheel body.

Then, refer to FIG. 4A for a cross section view along A-A' line of FIG. 2 before the assembly of wheel body; FIG. 4B for a cross section view along A-A' line of FIG. 2 after the assembly of wheel body; and FIG. 4C for a cross section view of along A-A' line of FIG. 2 for a detached wheel body. When a user installs and fixes the second wheel cover 24 of the wheel body 26 in the first receiving groove 32 of the first wheel cover 22, as shown in FIG. 4A, the user may exert force on the press piece 40, so that the guiding block 56 passes through the first hole 52 to outside the second hole 64, and due to the horizontal movement of the press piece 40 in a direction toward the first cover body 62, the second restoring spring 66 is in an elastically compressed state, meanwhile, the first slant side 60 of the guiding block 56 is pressed against the inner upper portion of the first hole 52, hereby bringing the connection rod 42 to move vertically upward in a direction to the first retaining part 50 along an inclination angle of the first slant side 60, so that the first restoring spring 58 is in an elastically compressed state.

Subsequently, as shown in FIG. 4B, the two dovetail tenons 38 corresponding to the two dovetail grooves 36 are moved inward to their bottom ends, thus fixing the second wheel cover 24 in the first receiving groove 32. Then, the user releases the press piece 40 to terminate the force exertion, and through the elastic restoration of the first restoration spring 58 and the second restoration spring 66, the connection rod 42 is moved vertically downward, and it passes through the first installation groove 46, to be positioned and fixed on the dent groove 44 of the second wheel cover 24, thus positioning and fixing the second wheel cover 24 in the first receiving groove 32. In this way, through positioning the connection rod 42 onto the dent groove 44, not only the dovetail tenons 38 and dovetail grooves 36 will not move after connection, but they also achieve the precise and fixed assembly of the second wheel cover 24 of the wheel body 26 into the first receiving groove 32 of the first wheel cover 22.

Figure 4C:
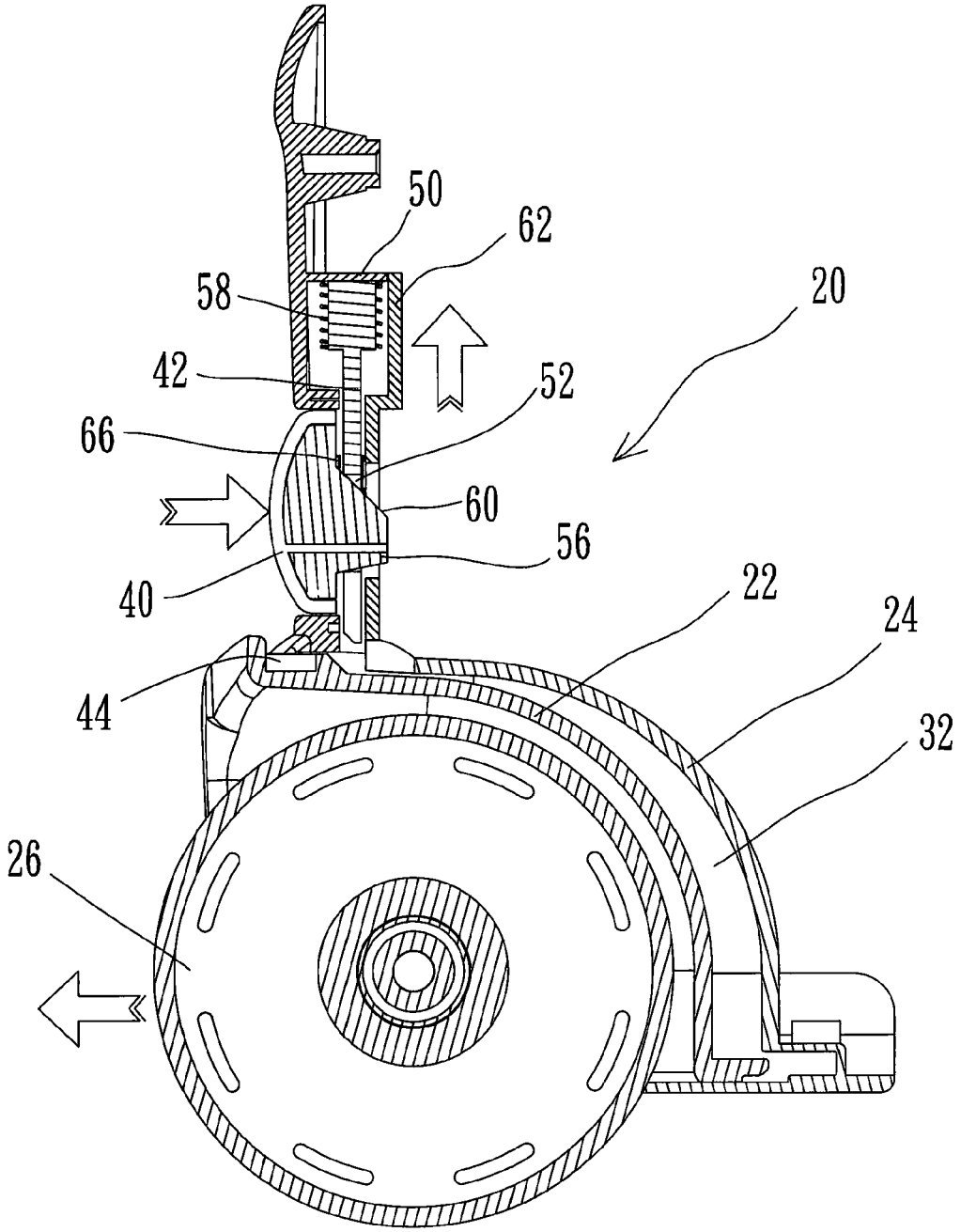
FIG. 4C is a cross section view along A-A' line of FIG. 2 for a detached wheel body.

When the user detaches the second wheel cover 24 of the wheel body 26 from its positioning state, as shown in FIG. 4C, the user exerts force again on the press piece 40, so that the guiding block 56 passes through the first hole 52 onto the second hole 64, and due to the horizontal movement of the press piece 40 in a direction toward the first cover body 62, the second restoring spring 66 is in an elastically compressed state, meanwhile, the first slant side 60 of the guiding block 56 is pressed against the inner upper portion of the first hole 52, hereby bringing the connection rod 42 to move vertically upward in a direction to the first retaining part 50 along an inclination angle of the first slant side 60, so that the first restoring spring 58 is in an elastically compressed state. At this time, the connection rod 42 is detached from the dent groove 44, hereby detaching the connection rod 42 and the dent groove 44 from the positioning state, such that the wheel body 26 is pulled away from the first wheel cover 22, hereby pulling the two dovetail tenons 38 out from the two dovetail grooves 36, in detaching the second wheel cover 24 of the wheel body 26 out of the first receiving groove 32.

From the description of FIGS. 4A to 4C it can be known that, the user need only to press the press piece 40, then the second wheel cover 24 of the wheel body 26 can be assembled or replaced swiftly. Moreover, in this process, no auxiliary tools are required, thus achieving advantages of labor saving, simple operation, and increased market demand.

Figure 5:
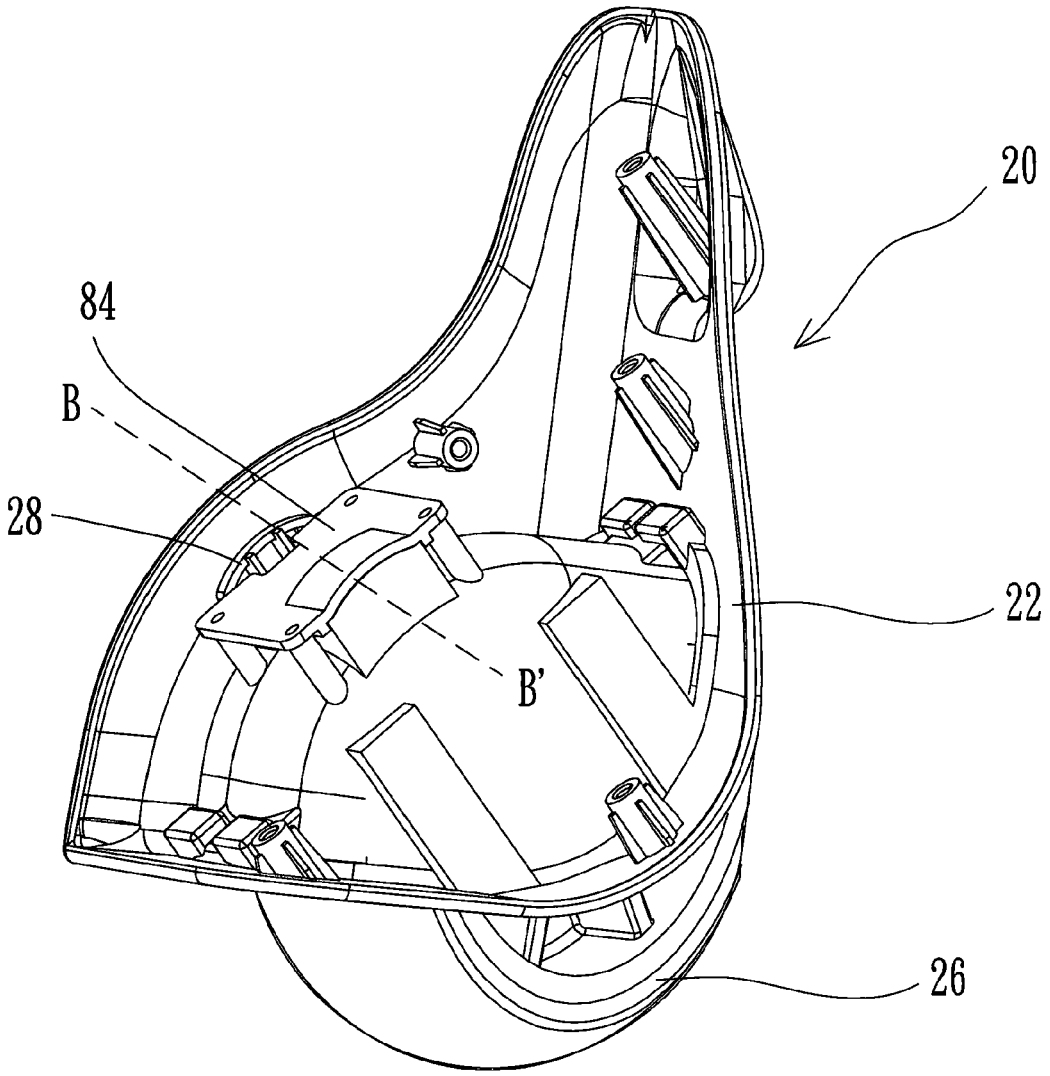
FIG. 5 is a perspective view of the fast detachable side wheel device according to the second embodiment of the present invention.
Figure 6:
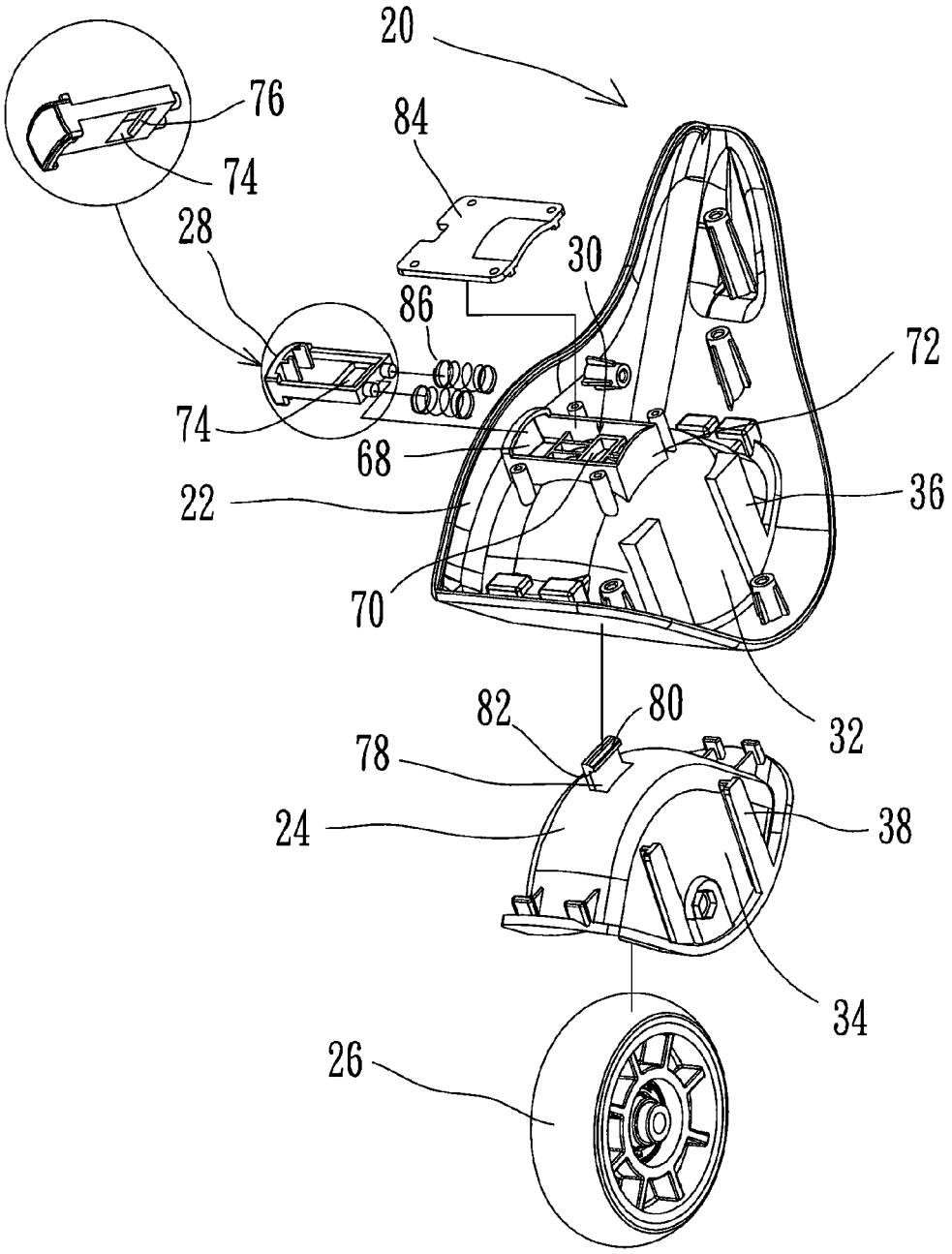
FIG. 6 is an exploded view of the fast detachable side wheel device according to the second embodiment of the present invention.

In addition to the forward positioning way mentioned above, another side positioning way is described as follows. Refer to FIGS. 5 and 6 for a perspective view and an exploded view respectively of the fast detachable side wheel device according to the second embodiment of the present invention. Since the second embodiment is different from the first embodiment is in its ways of positioning, therefore, only their differences are described; meanwhile, refer to the descriptions of the first embodiment. In the second embodiment, the installation part 30 includes a third installation groove 68, a fourth installation groove 70, and a second retaining part 72. The fourth installation groove 70 is in connection with the first receiving groove 32 of the first wheel cover 22, the second retaining part 72 is located on a side of the fourth installation groove 70. The positioning element is formed integrally with the movable component 28, so that the movable component 28 is installed in the third installation groove 68, and the positioning element is a third hole 74. Below the third hole 74 is extended a second slant side 76, and the third hole 74 is located correspondingly to the fourth installation groove 70, for the corresponding fixing and positioning of a positioning part of the second wheel cover 24. Herein, the positioning part is a positioning rod 78, with its front end extended a third slant side 80, and a positioning side 82 is located below. The fast detachable side wheel device 20 further includes a second cover body 84, which covers the movable component 28 and is fixed onto the installation part 30, and at least a third restoring spring 86 is connected between the movable component 28 and the second retaining part 72.

Figure 7A:
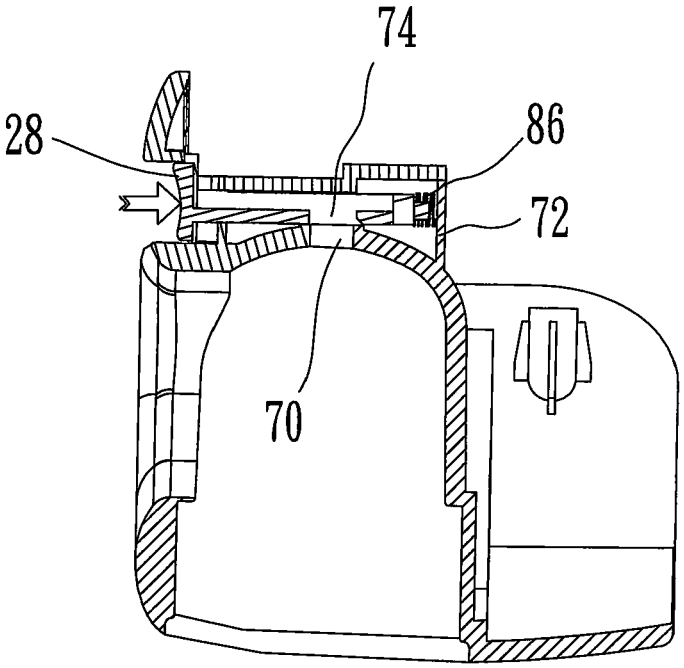
FIG. 7A is a cross section view along B-B' line of FIG. 5 before the assembly of wheel body.
Figure 7B:
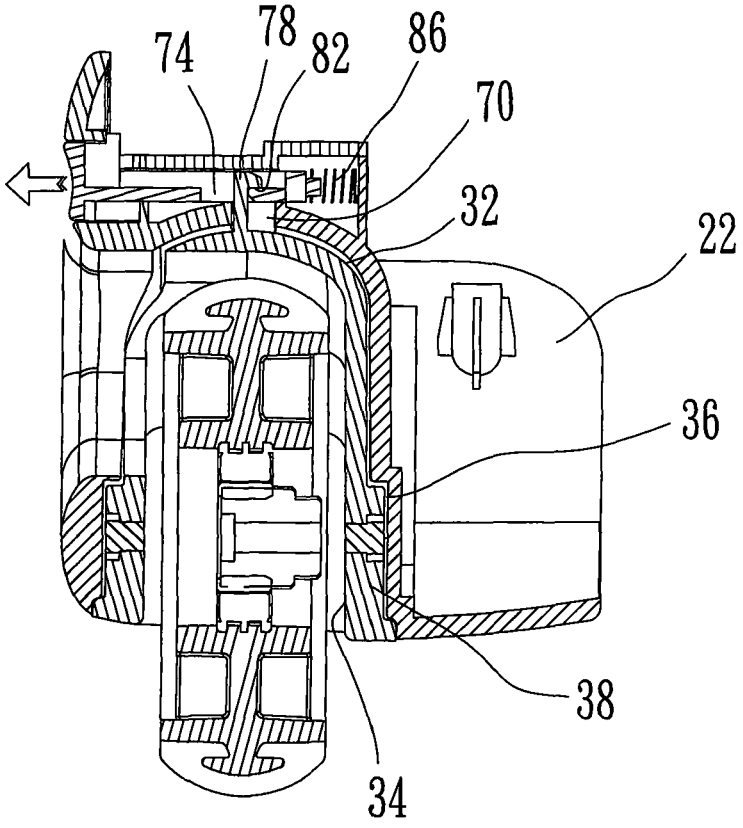
FIG. 7B is a cross section view along B-B' line of FIG. 5 after the assembly of wheel body.
Figure 7C:
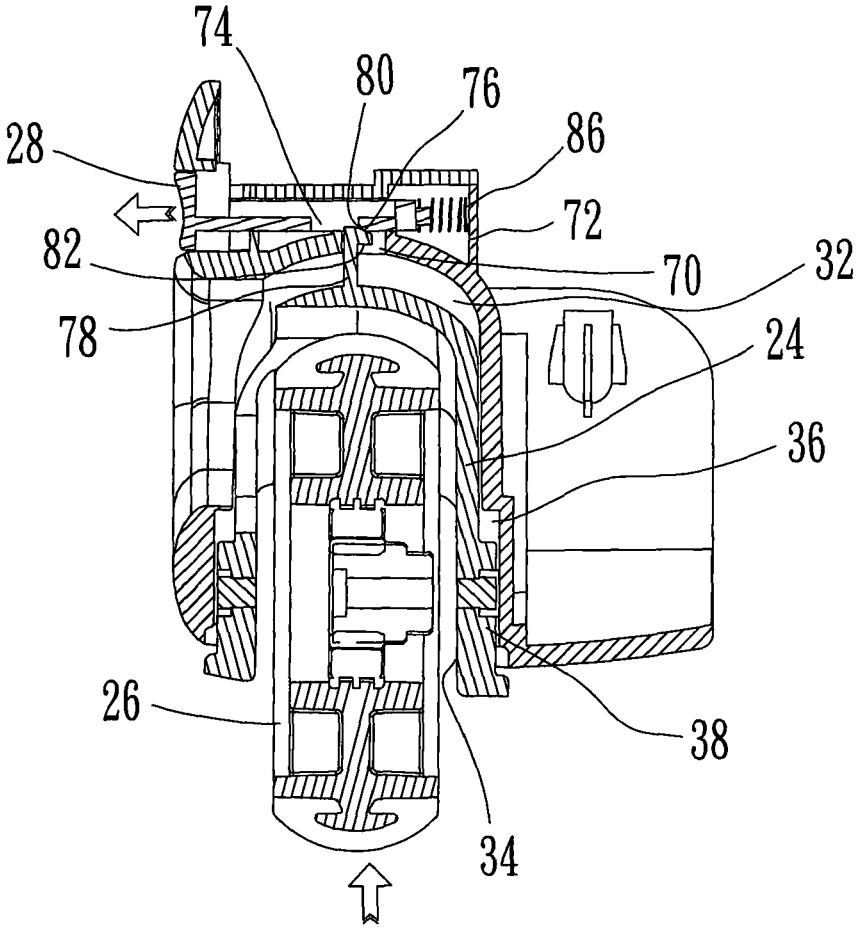
FIG. 7C is a cross section view along B-B' line of FIG. 5 before the assembly of another wheel body.

Then, refer simultaneously to FIG. 7A for a cross section view along B-B' line of FIG. 5 before the assembly of wheel body; FIG. 7B for a cross section view along B-B' line of FIG. 5 after the assembly of wheel body; FIG. 7C for a cross section view along B-B' line of FIG. 5 before the assembly of another wheel body; and FIG. 7D for a cross section view along B-B' line of FIG. 5 for a detached wheel body respectively. When the user installs and fixes the second wheel cover 24 of the wheel body 26 into the first receiving groove 32 of the first wheel cover 22, as shown in FIG. 7A, the user may exert force on the movable component 28, so that the movable component 28 move horizontally in a direction toward the second retaining part 72, and when the third hole 74 forms a complete connection with the corresponding fourth installation groove 70, the third restoring spring 86 is in an elastically compressed state.

As shown in FIG. 7B, the two dovetail tenons 38 outside the second receiving groove 34 are moved inward to their bottom ends corresponding to the two dovetail grooves 36 inside the first receiving groove 32. At this time, the front end of positioning rod 78 passes through the fourth installation groove 70 and reaches outside the third hole 74, then the user releases the moveable component 28 to terminate the force exertion, thus through the elastic restoration of the third restoring spring 86, the inner side of the third hole 74 is pressed against the positioning rod 78, thus positioning and fixing the positioning side 82 of the positioning rod 78 to the side position over the third hole 74. In this way, not only the dovetail tenons 38 and dovetail grooves 36 will not move after connection, but they can also be assembled fixedly and precisely into the first receiving groove 32 of the first wheel cover 22.

In addition to controlling the second wheel cover 24 of the wheel body 26 to position and fix into the first receiving groove 32 of the first wheel cover 22 by utilizing the movable component 28, moreover, as shown in FIG. 7C, the user may move the dovetail tenon 38 outside the second receiving groove 34 inward to its bottom end corresponding to the dovetail groove 36 inside the first receiving groove 32. At this time, the front end of positioning rod 78 passes through the fourth installation groove 70, such that the second slant side 76 is moved upward along the third slant side 80 of the third hole 74, so as to bring the movable components 28 to move in a direction toward the second retaining part 72, thus making the third restoring spring 86 in an elastically compressed state. When the third hole 74 is formed a partial connection with the corresponding fourth installation groove 70 until the front end of the positioning rod 78 passes through the third hole 74, then through the elastic restoration of the third restoration spring 86, the positioning side 82 is positioned and fixed to a side position over the third hole 74, hereby fixing the second wheel cover 24 of the wheel body 26 into the first receiving groove 32. In this way, by either pressing the movable component 28, or by connecting the movable component 28 through a slant side between the positioning rod 78 and the third hole 74, it is able to achieve easy positioning and fixing of the second wheel cover 24 of the wheel body 26 into the first receiving groove 32.

Figure 7D:
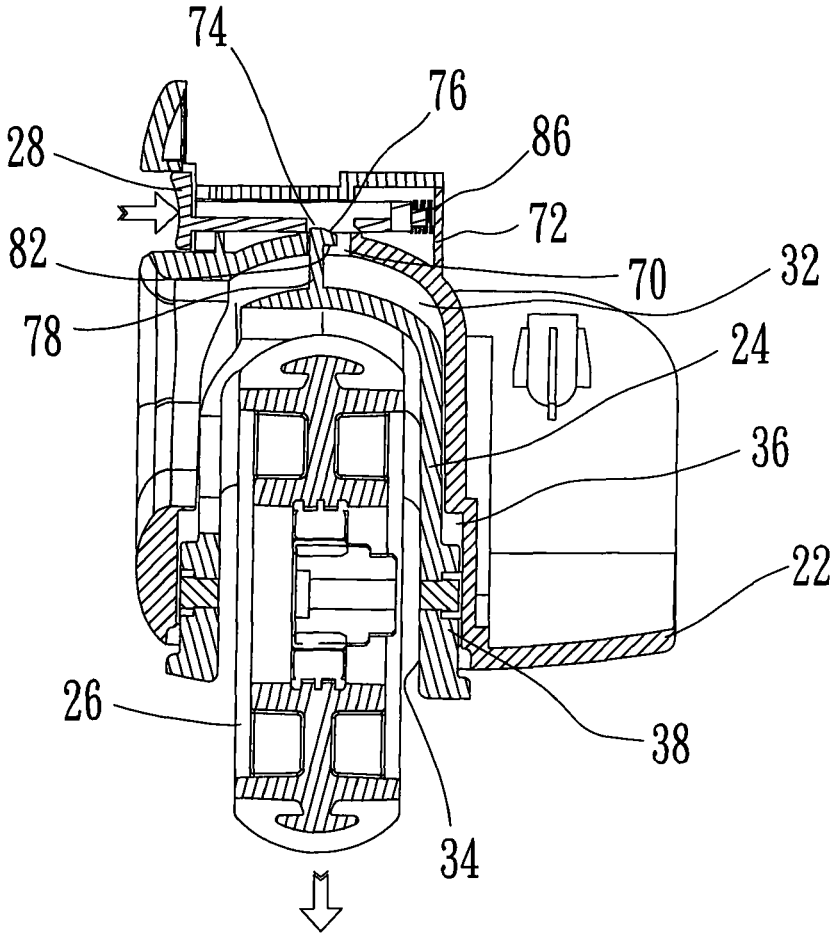
FIG. 7D is a cross section view along B-B' line of FIG. 5 for a detached wheel body.

When the user detaches the second wheel cover 24 of the wheel body 26 from its positioning state, as shown in FIG. 7D, the user exerts force again on the movable component 28, so that the movable component 28 moves horizontally in a direction to the second retaining part 72, and when the third hole 74 forms a complete connection with the corresponding fourth installation groove 70, the third restoring spring 86 is in an elastically compressed state, hereby detaching positioning rod 78 and the third hole 74 from the positioning state, and pulling the wheel body 26 away from the first wheel cover 22, in detaching the position rod 78 from the third hole 74 and the fourth installation groove 70; meanwhile pulling the dovetail tenon 38 out of the dovetail groove 36, in detaching the second wheel cover 24 of the wheel body 26 out of the first receiving groove 32.

From the description of FIGS. 7A to 7D it can be known that, the user need only control the operations of the movable component 28, and then be able to achieve fast assembly and replacement of the second wheel cover 24 of the wheel body 26.

Summing up the above, in the present invention, the second wheel cover and wheel body are designed and assembled as replaceable components, and in cooperation with the assembly and detachment of the first wheel cover, the second wheel cover, and the movable components, the fast detachable side wheel device of the present invention can be simple in construction, easy to operate and labor saving, thus it is applicable to various movable objects such as furniture, luggage trunks, and large-sized packing bags, and it can fulfill the requirement of various applications. Furthermore, in the present invention, the design of movable wheel body is utilized, thus in addition to reducing frictions between the movable object and the ground, increasing the service life of the movable objects, it can also provide user with the facility of easy and instant assembly or replacement of side wheels, hereby having a good competitive edge in the market.

The above detailed description of the preferred embodiment is intended to describe more clearly the characteristics and spirit of the present invention. However, the preferred embodiments disclosed above are not intended to be any restrictions to the scope of the present invention. Conversely, its purpose is to include the various changes and equivalent arrangements which are within the scope of the appended claims.

What is claimed is:

1. A fast detachable side wheel device, comprising:

a first wheel cover, provided with an installation part and a first receiving groove;

a second wheel cover, disposed in said first receiving groove, and is provided with a positioning part and a second receiving groove;

a wheel body, disposed in said second receiving groove; and a movable component, disposed in said installation part, and includes a positioning element, such that said movable component controls said positioning element to position and fix correspondingly to said positioning part, or to detach positioning of said positioning element and said positioning part;

wherein said installation part includes a first installation groove, a second installation groove, and a first retaining part, said second installation groove is in connection with said first receiving groove and is vertical to said first installation groove, and said first retaining part is located over said first installation groove; and wherein said movable component includes a press piece and a connection rod, said connection rod serves as said position element, said press piece is installed in said first receiving groove, said connection rod is installed in said second installation groove, and said connection rod is provided with a first hole and an extension part, said first hole corresponds to a guiding block of said press piece, said extension part is provided for at least a first restoring spring to sleeve on and said first restoring spring is pressed against said first retaining part.

2. The fast detachable side wheel device as claimed in claim 1, further comprising:

a first cover body, provided with a second hole corresponding to said first hole, said first cover body covers said movable component and is fixed onto said first installation groove, and a second restoring spring is connected between said first cover body and said press piece.

3. The fast detachable side wheel device as claimed in claim 2, wherein said positioning part is a dent groove, said press piece controls said connection rod to pass through said first installation part and to position and fix it onto said dent groove of said second wheel cover, then position and fix said second wheel cover into said first receiving groove.

4. The fast detachable side wheel device as claimed in claim 2, wherein said positioning part is said dent groove, said press piece controls said connection rod to move in a direction of said first retaining part, for detaching said connection rod and said dent groove from a positioning state, and then detaching said second wheel cover of said wheel body out of said first receiving groove.

5. The fast detachable side wheel device as claimed in claim 1, wherein an inner side of said first receiving groove of said first wheel cover is provided with at least a dovetail groove, and an outer side of said second receiving groove of said second wheel cover is provided with at least a dovetail tenon, said dovetail groove is for said dovetail tenon to move correspondingly and fix therein.

* * * * *